US005796346A

United States Patent [19]

Wash et al.

[11] Patent Number: 5,796,346

[45] Date of Patent: Aug. 18, 1998

[54] STOVE HAVING GREASE FIRE AVOIDANCE CIRCUITRY

[76] Inventors: Richard L. Wash, 310 G Calhoun Ave., Greenwood, S.C. 29649; James S. McClary, 312 Hunting Rd., Greenwood, S.C. 29646

[21] Appl. No.: 147,979

[22] Filed: Nov. 4, 1993

[51] Int. Cl.[6] ..... H05B 1/02

[52] U.S. Cl. ..... 340/635; 340/640; 340/588; 219/448; 219/489; 219/490; 219/494

[58] Field of Search ..... 340/635, 640, 340/588; 212/448, 489, 490, 494

[56] References Cited

U.S. PATENT DOCUMENTS

| | | | |
|---|---|---|---|
| 2,055,384 | 9/1936 | Meacham . | |
| 2,208,956 | 7/1940 | Allenbaugh . | |
| 2,626,661 | 1/1953 | McDowell . | |
| 3,186,472 | 6/1965 | Caravella . | |
| 4,070,670 | 1/1978 | Chen . | |
| 4,577,181 | 3/1986 | Lipscher et al. . | |
| 4,737,617 | 4/1988 | Payne | 340/588 |
| 4,812,625 | 3/1989 | Ceste, Sr. | 340/588 |
| 5,073,701 | 12/1991 | Ljunggren | 340/588 |
| 5,416,301 | 5/1995 | Aoshima | 340/640 |
| 5,608,383 | 3/1997 | Neil | 340/588 |

*Primary Examiner*—Edward Lefkowitz
*Attorney, Agent, or Firm*—Dority & Manning, P.A.

[57] ABSTRACT

A stove including circuitry to facilitate avoidance of fires such as may be caused by grease or another flammable substance present on the stove burner. The circuitry detects when such burner has been set above a predetermined temperature or power level for a selected duration and responsively disengages same. In presently preferred embodiments, the circuitry includes an indicator circuit operative to produce an output when the predetermined temperature or power level has been exceeded. This output initiates operation of a timer circuit which will itself produce an output after the selected duration. An appropriate switching circuit is provided to then disengage the burner as desired.

17 Claims, 3 Drawing Sheets

STOVE HAVING GREASE FIRE AVOIDANCE CIRCUITRY

BACKGROUND OF THE INVENTION

The present invention relates to a stove in which heating elements thereof are equipped with circuitry to facilitate avoidance of fires such as may be caused by grease. More particularly, the invention relates to a stove utilizing circuitry to detect when an individual heating element has been set above a predetermined temperature for a selected duration and responsively disengage such element.

The kitchen is one of the most likely starting points for fires. Grease fires are particularly dangerous and unfortunately common. A means of detecting when a stove's heating element has been operating for a period of time at a temperature sufficient to ignite grease and automatically disengaging this element may greatly reduce the number of such fires.

Various devices have been provided in the art for controlling the operation of a heating element or burner on a stove. U.S. Pat. No. 4,577,181 to Lipscher discloses an alarm system that detects when a stove burner is energized without a pan thereon. While this device would warn a user of a burner which he forgot to turn off, it would not turn the burner off. Therefore, the device is ineffective in preventing grease fires resulting from unattended burners.

U.S. Pat. No. 4,070,670 to Chen discloses a shut-off device for the heating element of a cooking stove. The purpose of this device, however, is to prevent the continuous leaking of flammable gas which could otherwise result when a gas burner is extinguished by spillage of water overflowing from cooking utensils. In addition to being ineffective with an electric heating element, this device would be ineffective in preventing grease fires resulting from overheated pans on a gas burner.

U.S. Pat. No. 3,186,472 to Caravella discloses a system for indicating an elevated temperature condition at the heating elements of a kitchen range. As with the Lipscher device, this device fails to disengage the heating element, thereby failing to prevent kitchen fires originating from unattended ranges or stoves.

U.S. Pat. No. 2,626,661 to McDowell discloses a time-controlled fuel feed mechanism for gas burners. While this mechanical device disengages gas flow to a gas burner, it is not dependent upon temperature. It disengages gas flow after a predetermined time after the timer has been engaged by the operator, rather than from the setting of the burner to a selected temperature. Therefore, any safety effect is negated if the operator simply fails to start the timer. Additionally, the device is inapplicable to electric ranges and stoves.

U.S. Pat. No. 2,208,956 to Allenbaugh discloses a fuel burner and control which disengages a pair of gas burners after varied, predetermined time intervals. This device suffers from disadvantages similar to those of the patent to McDowell.

U.S. Pat. No. 2,065,384 to Meacham discloses a gas range having an operator-controlled timer mechanism which controls the fuel to gas burners. This device suffers from disadvantages similar to the patents to Allenbaugh and McDowell.

The apparatus and method of the present invention represent a novel technique for avoiding grease fires associated with the heating elements of a stove or range. The prior art neither teaches nor suggests the claimed combination of the present invention.

SUMMARY OF THE INVENTION

The present invention recognizes and addresses various of the foregoing drawbacks, and others, concerning stoves or ranges. Thus, broadly speaking, one main object of the present invention is to provide improved cooking stoves.

It is another principal object of the present invention to provide a stove which is generally less likely to develop a grease fire than prior art stoves.

It is another object of the invention to provide circuitry to detect when an undesirable condition has occurred at an individual heating element or burner which could occasionally result in a grease fire.

It is another object of the invention to provide means to alert an operator of the occurrence of such an undesirable condition.

Additional objects and advantages of the invention are set forth in, or will be apparent to those of ordinary skill in the art from, the detailed description set forth below. Also, it should be further appreciated that modifications and variations to the specifically illustrated and discussed features or materials hereof may be practiced in various embodiments and uses of this invention without departing from the spirit and scope thereof, by virtue of present reference thereto. Such variations may include, but are not limited to, substitution of equivalent means and features or materials for those shown and discussed, and the functional or positional reversal of various parts, features, or the like.

Still further, it is to be understood that different embodiments, as well as different presently preferred embodiments, of this invention may include various combinations or configurations of presently disclosed features or elements, or their equivalents (including combinations or configurations thereof not expressly shown in the figures or stated in the detailed description). One exemplary such embodiment provides a stove including circuitry in which individual heating assemblies thereof may disengaged when left above a predetermined temperature or power setting for a selected duration. Another presently preferred embodiment concerns an electric heating apparatus equipped according to the teachings of the invention.

Circuitry for effecting these functions may include indicator means operatively connected to the control actuator used to set the heating level of the heating assembly. The indicator means indicate to timer means that the heating assembly has been set above the predetermined level. If the setting continues for the selected duration, such timer means will produce an appropriate output. This output is received by appropriate switching means, which responsively disengage the heating element.

In some presently preferred embodiments, the switching means may comprise the combination of bistable means and buffer means. The bistable means are electrically connected to receive an output from the timer means indicating that an undesirable condition has occurred. A switching initiation signal is responsively produced, which is received by the buffer means. The buffer means includes at least one switching element which are then actuated to interrupt power to the heating element.

In some presently preferred embodiments, the bistable circuitry may comprise a toggle flip-flop wherein the switching signal output produced thereby is a digital "low" signal. When a monolithic timer is utilized, the output of the flip-flop may be connected to a power supply input of such monolithic timer. Therefore, the timer will be deactivated when the switching signal is present. The buffer circuitry may comprise a monolithic quad noninverting buffer.

The accompanying drawings, which are incorporated in and constitute a part of the specification illustrate presently preferred embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures in which.

DETAILED DESCRIPTION OF PREFERRED EMBODIMENTS

Reference will now be made in detail to the presently preferred embodiment of the invention illustrated in the accompanying drawings. The drawings are provided by way of explanation of the invention, not limitative thereof. In fact, it will be apparent to those skilled in the art upon viewing the specification and drawings herein that various modifications and variations can be made without departing from the scope or spirit of the invention. For instance, it may be recognized by those skilled in the art that much of the circuitry of the preferred embodiment may be realized on a single application specific integrated circuit (ASIC).

As discussed above, the present invention is concerned with avoiding fires caused by contact of a foreign substance, such as grease, with a heating element on stove or the like. Conventional alarm or interrupt systems typically depend upon a user to set a timer. This significantly reduces the effectiveness of such devices. In accordance with the present invention, it is possible to cure this deficiency by enabling a timer whenever the heating element reaches or exceeds a heat setting capable of igniting the foreign substance.

Figure 1:
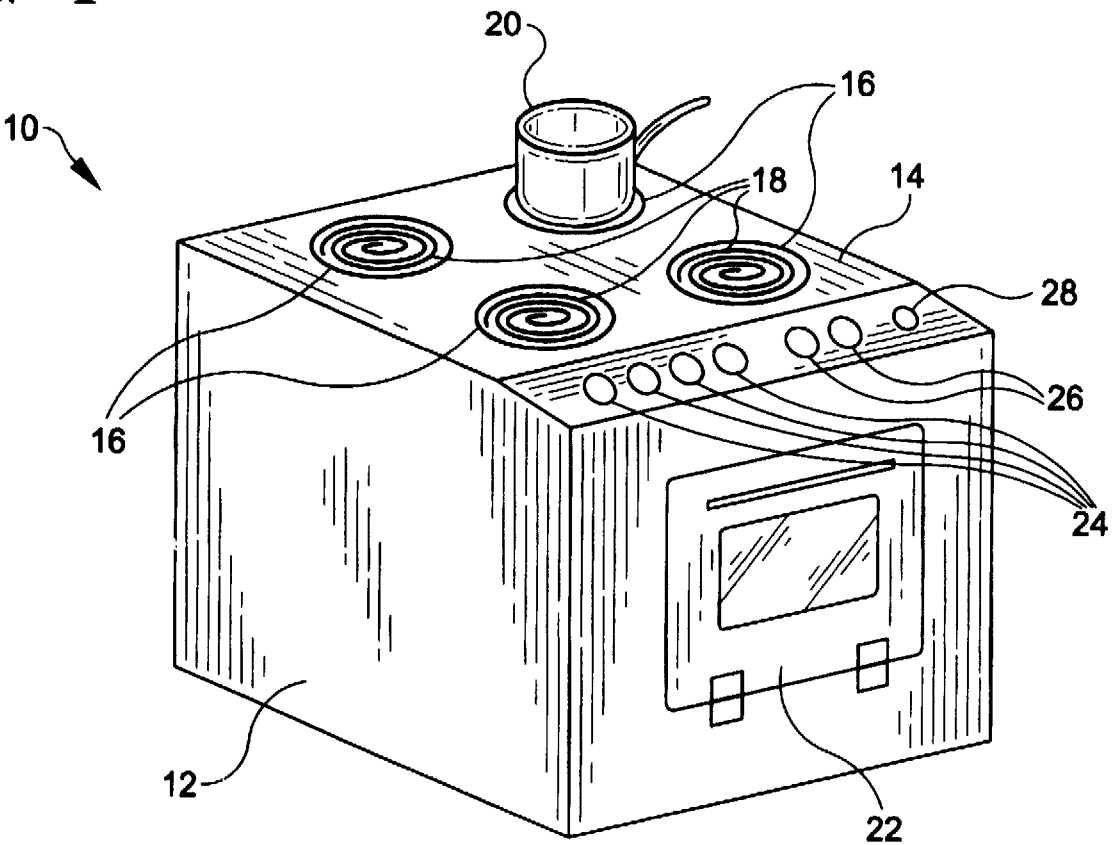
FIG. 1 is a perspective view of a stove such as may be constructed in accordance with teachings of the present invention.

Accordingly, a preferred embodiment of the present invention is outlined generally in FIG. 1. Stove 10 is conventionally constructed having a stove body 12 defining a stovetop surface 14. Stovetop surface 14 includes a number of holes 16 into which respective heating elements 18 are mounted. Heating elements 18 are adapted to support and heat a cooking utensil placed thereon, such as pot 20. Stove 10 may also include an oven, which is accessed through oven door 22. The user of stove 10 here controls the heating level of heating elements 18 via respective of control knobs 24. Similarly, the oven setting and temperature are selectively controlled using knobs 26.

According to the invention, it has been found that certain high heating levels may, in the presence of foreign substances such as grease, ignite a fire after a period of time. Therefore, the invention provides circuitry that will disengage the heating element before such time. Additionally, some presently preferred embodiments provide that an alarm will be activated, thus alerting the user of the undesirable condition. The user may then take appropriate remedial action, and subsequently reset stove 10 via reset button 28.

Figure 2:
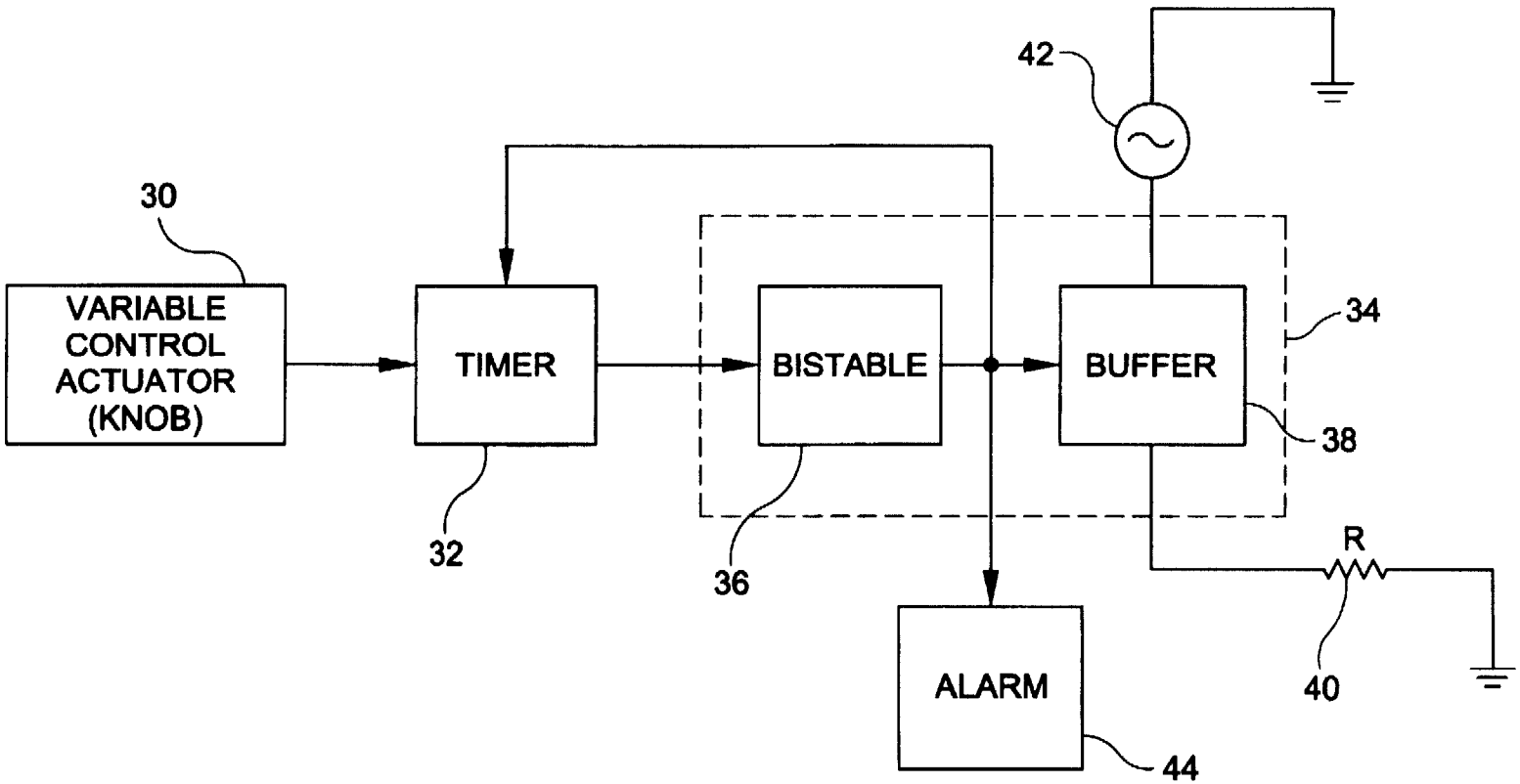
FIG. 2 is a block diagram illustrating the functional relationship of circuitry which may used with each heating element of the stove of FIG. 1.

Presently preferred circuitry for facilitating the avoidance of fires caused by substances such as grease is functionally illustrated in FIG. 2. The circuit provides indicator means, generally designated at 30, which produce an appropriate output signal when the variable control actuator for the associated heating element has been set above the predetermined level at which a grease fire may be eminent. For example, for stoves having a control knob adjustable over a range of one (1) to ten (10), such a signal may be produced when the control knob is set above eight (8).

The output of indicator means 30 is fed to a timer (generally designated as 32), whereby a timing sequence is initiated. Specifically, if the input to timer 32 continues for at least a preselected duration, a timing output signal will be produced. If, however, the input to timer 32 is discontinued before the preselected duration has elapsed, no timing output signal will be produced. In presently preferred embodiments, the duration of this sequence should generally correspond to a length of time just shorter than the period required to ignite the flammable substance at the threshold heat level to which indicator means 30 is responsive.

The output of timer 32 is connected to switching circuitry, generally designated at 34. In most exemplary embodiments, switching circuitry 34 includes the combination of bistable circuitry 36 and buffer circuitry 38. Upon receipt of the timing output signal, bistable circuitry 36 changes the state of its output from its "normal" state to its "switching" state. This change of state constitutes a switching initiation signal, which is passed to buffer circuitry 38. The output of bistable circuitry 36 is also preferably fed back to timer 32, causing it to be deactivated.

As can be seen, buffer circuitry 38 is electrically connected interposing the respective heating element (schematically represented by a resistor 40 of resistance value, R) and an external supply source 42 of electrical energy. When the output of bistable circuitry 36 remains in its normal state, current is allowed to flow between heating element 40 and source 42. The switching state, however, causes switching elements internal to buffer circuitry 38 to interrupt such flow of current, thereby disengaging heating element 40.

The output of bistable circuitry 36 may also be fed to an alarm 44. Alarm 44 will be responsively activated, thus alerting the user that a situation requiring attention has arisen. In presently preferred embodiments, alarm 44 may comprise both audible and visual devices.

Figure 3:
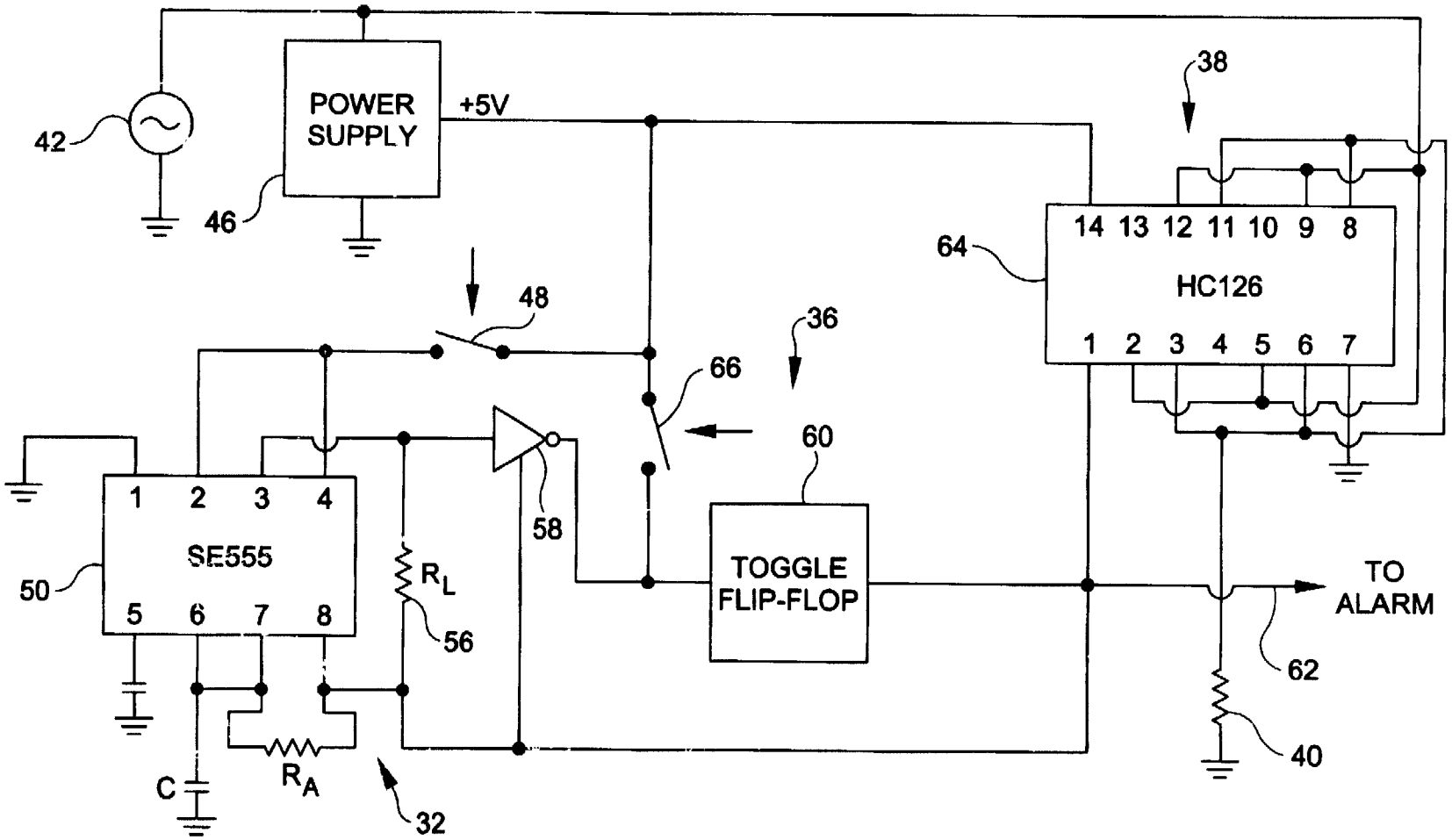
FIG. 3 is a schematic diagram of a presently preferred circuit such as is functionally represented in FIG. 2.

FIG. 3 illustrates a detailed schematic of a circuit constructed according to the teachings of the present invention. This circuit is constructed of digital circuit components powered from a power supply 46. Power supply 46 converts electrical energy from source 42 to the appropriate Vcc level, e.g., +5 VDC.

A switch 48 is provided to complete a circuit from power supply 46 to the input of timer 32. In this exemplary embodiment, timer 32 comprises a SE555 monolithic timer chip 50 (such as is distributed by Texas Instruments, Inc.) having the following pin assignments: pin 1—ground, pin 2—trigger input, pin 3—output, pin 4—reset, pin 5—control voltage, pin 6—threshold, pin 7—discharge, pin 8—Vcc. The various pins of chip 50 are connected in a monostable configuration, with the duration of the timing sequence determined by the values of resistor 52 (having resistance Ra) and capacitor 54 (having capacitance C). Values C and Ra (as well as resistance Rl of resistor 56) depend on the particular operating parameters of the stove.

As can be seen, the input signal produced by closure of switch 48 is fed to both pins 2 and 4 of chip 50. When the timing sequence ends, the output of pin 3 will fall from a digital "high" level to a digital "low" level. Inverter 58 converts this signal to a rising edge pulse leading to the input of a bistable flip-flop 60. Preferably, flip-flop 60 may be a rising-edge-triggered toggle flip-flop. Receipt of the timer output signal will therefore cause its output to responsively change state.

In the illustrated exemplary embodiment, this change of state will be from "high" to "low". This is advantageous in that the output of flip-flop 60 be connected to directly provide Vcc power to chip 50 and inverter 58. Thus, chip 50 and inverter 58 will be deactivated, as desired, when the output state of flip-flop 60 changes. The output of flip-flop 60 is also fed to an alarm via line 62. The alarm will also be activated by the low pulse.

The output of flip-flop 60 is fed to buffer circuitry 38. In this exemplary embodiment, buffer circuitry 38 comprises a quad three-state noninverting buffer chip 64. An acceptable commercial chip for this purpose is model HC126, distributed by Motorola, Inc. With such a chip, input pins 2,5,9,12 may be connected in parallel to source 42. Similarly, output pins 3,6,8,11 may be parallel-connected to heating element 40. Pins 7 and 14 are the ground and Vcc pins, respectively.

The "output enable" input of chip 64, provided at pin 1, is "active high". Thus, the "low" output signal of flip-flop 60 causes the four internal solid state switching elements to each open. Therefore, heating element 40 will be disengaged from source 42, as desired.

As discussed above, a circuit reset is provided to permit normal stove operation to resume after the user has had an opportunity to take proper remedial action. Specifically, when reset button 28 (FIG. 1) is depressed, switch 66 is caused to close. This sends a high pulse to the input of flip-flop 60. Flip-flop 60 is thereby toggled back into its "normal" state. As a result, a high pulse is sent to chip 64 to re-engage heating element 40. Chip 50 and inverter 58 are also reactivated. Additionally, the alarm is deactivated as desired. It should be noted that, if the stove knob remains set at or above a point sufficient to close switch 48, the timing sequence will immediately begin anew.

While a particular embodiment of the invention has been described and shown, it will be understood by those of ordinary skill in this art that the present invention is not limited thereto. For example, the teachings of the invention are not limited to kitchen stoves, but may be applied to any heating apparatus subject to fires caused by contact of foreign substances with the heating element. Additionally, while switches 48 and 66 are shown for purposes of illustration to be mechanical switches, it should be appreciated that solid state switching elements will frequently be utilized. It is therefore intended that the present invention will cover such modifications and variations as come within the scope of the appended claims and their equivalents.

What is claimed is:

1. An improved stove for heating a cooking utensil adapted to prevent grease fires, said stove comprising:

a stove body having a stovetop surface, said stovetop surface defining at least one burner opening therein;

a heating assembly mounted in said opening and adapted to support the utensil during heating thereof;

variable control means for permitting a user to adjust the heating temperature of said heating assembly;

supply means for connecting said heating assembly to an external supply source; and circuit means for detecting an undesirable condition in which said heating assembly has been set by said variable control means to greater than a predetermined level for a selected duration such that said heating assembly will exceed a grease ignition temperature and responsibly disengaging said heating assembly from said supply means, said circuit means including:

a. timer means operatively connected to said control means for producing an output only when said predetermined level has been exceeded for said selected duration; and b. switching means electrically connected to receive an output of said timer means for responsively disengaging said heating assembly from said supply means such that said heating assembly will not exceed the ignition temperature.

2. An improved stove as in claim 1, wherein said circuit means further comprises an alarm operable to provide an indication when the undesirable condition has been detected.

3. An improved stove as in claim 2, wherein said circuit means further comprises reset means for permitting a user to reset said stove after said undesirable condition has been detected.

4. An improved stove as in claim 3, wherein said reset means are operative to engage said heating assembly with said supply means and are further operative to deactivate said alarm.

5. An improved stove as in claim 1, wherein said switching means comprises:

bistable means electrically connected to receive an output of said timer for responsively producing a switching initiation signal; and buffer means electrically connected to receive said switching initiation signal for responsively disengaging said heating assembly from said supply means.

6. An electric heating assembly adapted to prevent grease fires comprising:

an electric heating element electrically connectable to a source of electrical energy;

a variable control actuator electrically connected in series with said source of electrical energy and operable to selectively vary an amount of electrical energy applied to said electric heating element;

indicator means operatively connected to said variable control actuator for indicating that said heating element is set to heat at an excessive level such that said heating element will exceed a grease ignition temperature;

timer circuitry electrically connected to said indicator means, said timer circuitry producing a timer output signal only when said heating assembly has been set at said excessive level for a selected duration; and switching circuitry electrically connected to receive said timer output signal for responsively disengaging said heating element from said source of electrical energy such that said heating element will not exceed the grease ignition temperature.

7. An electric heating assembly as in claim 6, wherein said switching circuitry comprises:

bistable circuitry electrically connected to receive said timer output signal, said bistable circuitry responsively producing a switching signal; and buffer circuitry having at least one switching element serially connectable between said electrical energy source and said heating element, said buffer circuitry further connected to receive said switching initiation signal and responsively actuate said at least one switching element.

8. An electric heating assembly as in claim 7, further comprising a reset switch electrically connected to an input of said bistable circuitry to abolish said switching signal.

9. An electric heating assembly as in claim 8, further comprising an alarm electrically connected to an output of said bistable means and operative to be activated by said switching signal.

10. A circuit arrangement useable with an electric stove to detect when a heating element thereof has been heating at an excessive level for a selected duration and responsively disengaging the heating element in order to prevent grease fires, said circuit arrangement comprising:

indicator means for indicating that said heating element is heating at the excessive level such that said heating element will exceed a grease ignition temperature;

timer circuitry electrically connected to said indicator means, said timer circuitry producing a timer output signal when said heating assembly has been set at said excessive level for a selected duration;

bistable circuitry electrically connected to receive said timer output signal, said bistable circuitry responsively producing a switching signal; and buffer circuitry having at least one switching element serially connectable between said electrical energy source and said heating element, said buffer circuitry further connected to receive said switching initiation signal and responsively actuate said at least one switching element such that said heating element will not exceed the grease ignition temperature.

11. A circuit arrangement as in claim 10, further comprising a reset switch electrically connected to an input of said bistable means and operable to abolish said switching signal.

12. A circuit arrangement as in claim 11, further comprising an alarm electrically connected to an output of said bistable circuitry and operative to be activated by said switching signal.

13. A circuit arrangement as in claim 11, wherein said bistable circuitry comprises a toggle flip-flop.

14. A circuit arrangement as in claim 13, wherein said switching signal is a digital "low" signal.

15. A circuit arrangement as in claim 14, wherein said timer circuitry comprises a monolithic timer having a power supply input and further wherein an output of said flip-flop is electrically connected to said power supply input of said monolithic timer, whereby said monolithic timer will be deactivated when said switching signal is present.

16. A circuit arrangement as in claim 15, wherein said timer circuitry further comprises an inverter serially connected between an output of said monolithic timer and an input of said toggle flip-flop.

17. A circuit arrangement as in claim 16, wherein said buffer circuitry comprises a monolithic quad noninverting buffer.

* * * * *